US011087644B2

(12) United States Patent
Paolini, Jr. et al.

(10) Patent No.: US 11,087,644 B2
(45) Date of Patent: Aug. 10, 2021

(54) DISPLAYS INTENDED FOR USE IN ARCHITECTURAL APPLICATIONS

(71) Applicant: E Ink Corporation, Billerica, MA (US)

(72) Inventors: Richard J. Paolini, Jr., Framingham, MA (US); Carl Taussig, Woodside, CA (US); Seth J. Bishop, Framingham, MA (US); David Victor Marcolin, Vancouver (CA); Russell J. Dewitte, Mendon, MA (US)

(73) Assignee: E Ink Corporation, Billerica, MA (US)

( * ) Notice: Subject to any disclaimer, the term of this patent is extended or adjusted under 35 U.S.C. 154(b) by 0 days.

(21) Appl. No.: 16/940,299

(22) Filed: Jul. 27, 2020

(65) Prior Publication Data

US 2020/0357309 A1 Nov. 12, 2020

Related U.S. Application Data

(63) Continuation-in-part of application No. 15/241,114, filed on Aug. 19, 2016, now abandoned.

(60) Provisional application No. 62/207,066, filed on Aug. 19, 2015.

(51) Int. Cl.

| | |
|---|---|
| ***G09G 5/00*** | (2006.01) |
| ***G09F 7/00*** | (2006.01) |
| ***G09F 9/37*** | (2006.01) |

(52) U.S. Cl.

CPC ..... *G09F 7/002* (2013.01); *G09F 9/372* (2013.01)

(58) Field of Classification Search

None

See application file for complete search history.

(56) References Cited

U.S. PATENT DOCUMENTS

| | | | | |
|---|---|---|---|---|
| 4,843,460 | A | 6/1989 | Le Guet et al. | |
| 5,930,026 | A | 7/1999 | Jacobson et al. | |
| 5,933,150 | A | 8/1999 | Ngo et al. | |
| 5,936,633 | A | 8/1999 | Aono et al. | |
| 6,017,584 | A | 1/2000 | Albert et al. | |
| 6,252,564 | B1 * | 6/2001 | Albert | G09F 9/372 345/1.3 |
| 6,304,333 | B1 | 10/2001 | Shaked et al. | |
| 6,312,304 | B1 * | 11/2001 | Duthaler | G02F 1/1362 445/24 |
| 6,445,489 | B1 | 9/2002 | Jacobson et al. | |

(Continued)

OTHER PUBLICATIONS

Arad, Nur et al., "Barycentric Screening", Hewlett Packard Computer Peripherals Laboratory, HPL-97-103(R.1), (Nov. 1999).

(Continued)

*Primary Examiner* — Kirk W Hermann

(74) *Attorney, Agent, or Firm* — Brian D. Bean

(57) ABSTRACT

A display (100) primarily intended for use on an external surface of a building comprises a weatherproof housing (310, 340); a bistable electro-optic medium (326) enclosed within and visible through the housing; an electrode (324, 330) enclosed within the weatherproof housing and arranged to drive the electro-optic medium; a power source (504) enclosed within the weatherproof housing; data receiving means (508) enclosed within the weatherproof housing and arranged to receive data wirelessly from a source outside the weatherproof housing; and display drive means (510) arranged to receive data from the data receiving means and power from the power source, and to control the potential of the electrode.

5 Claims, 9 Drawing Sheets

(56) References Cited

U.S. PATENT DOCUMENTS 6,504,524 B1 1/2003 Gates et al.
6,512,354 B2 1/2003 Jacobson et al.
6,531,997 B1 3/2003 Gates et al.
6,545,797 B2 4/2003 Chen et al.
6,577,317 B1 6/2003 Duluk, Jr. et al.
6,664,944 B1 12/2003 Albert et al.
6,753,999 B2 6/2004 Zehner et al.
6,788,452 B2 9/2004 Liang et al.
6,825,970 B2 11/2004 Goenaga et al.
6,864,875 B2 3/2005 Drzaic et al.
6,891,548 B2 5/2005 Alcorn et al.
6,900,851 B2 5/2005 Morrison et al.
6,914,714 B2 7/2005 Chen et al.
6,937,365 B2 8/2005 Gorian et al.
6,972,893 B2 12/2005 Chen et al.
6,995,550 B2 2/2006 Jacobson et al.
7,012,600 B2 3/2006 Zehner et al.
7,023,420 B2 4/2006 Comiskey et al.
7,027,660 B2 4/2006 Hersch et al.
7,034,783 B2 4/2006 Gates et al.
7,038,656 B2 5/2006 Liang et al.
7,038,670 B2 5/2006 Liang et al.
7,046,228 B2 5/2006 Liang et al.
7,052,571 B2 5/2006 Wang et al.
7,053,894 B2 5/2006 Grzeszczuk et al.
7,054,038 B1 5/2006 Ostromoukhov et al.
7,061,166 B2 6/2006 Kuniyasu
7,061,662 B2 6/2006 Chung et al.
7,062,419 B2 6/2006 Grzeszczuk et al.
7,075,502 B1 7/2006 Drzaic et al.
7,116,466 B2 10/2006 Whitesides et al.
7,119,772 B2 10/2006 Amundson et al.
7,167,155 B1 1/2007 Albert et al.
7,177,066 B2 2/2007 Chung et al.
7,193,625 B2 3/2007 Danner et al.
7,202,847 B2 4/2007 Gates
7,236,649 B2 6/2007 Fenney
7,242,514 B2 7/2007 Chung et al.
7,259,744 B2 8/2007 Arango et al.
7,265,870 B2 9/2007 Velde et al.
7,304,787 B2 12/2007 Whitesides et al.
7,312,794 B2 12/2007 Zehner et al.
7,327,511 B2 2/2008 Whitesides et al.
7,330,193 B2 2/2008 Bhattacharjya
7,355,597 B2 4/2008 Laidlaw et al.
7,385,751 B2 6/2008 Chen et al.
7,408,699 B2 8/2008 Wang et al.
7,423,791 B2 9/2008 Tin
7,453,445 B2 11/2008 Amundson
7,466,314 B2 12/2008 Loop et al.
7,492,339 B2 2/2009 Amundson
7,492,505 B2 2/2009 Liang et al.
7,528,822 B2 5/2009 Amundson et al.
7,545,358 B2 6/2009 Gates et al.
7,583,251 B2 9/2009 Arango et al.
7,602,374 B2 10/2009 Zehner et al.
7,612,760 B2 11/2009 Kawai
7,623,739 B2 11/2009 Hersch et al.
7,659,920 B2 2/2010 Cohen et al.
7,667,684 B2 2/2010 Jacobson et al.
7,679,599 B2 3/2010 Kawai
7,679,813 B2 3/2010 Liang et al.
7,683,606 B2 3/2010 Kang et al.
7,684,108 B2 3/2010 Wang et al.
7,688,297 B2 3/2010 Zehner et al.
7,729,039 B2 6/2010 LeCain et al.
7,733,311 B2 6/2010 Amundson et al.
7,733,335 B2 6/2010 Zehner et al.
7,737,989 B2 6/2010 Pettitt et al.
7,787,169 B2 8/2010 Abramson et al.
7,791,789 B2 9/2010 Albert et al.
7,800,628 B2 9/2010 Harville et al.
7,800,813 B2 9/2010 Wu et al.
7,821,702 B2 10/2010 Liang et al.
7,839,564 B2 11/2010 Whitesides et al.
7,854,518 B2 12/2010 Culbertson et al.
7,859,742 B1 12/2010 Chiu et al.
7,868,887 B1 1/2011 Yhann
7,907,792 B2 3/2011 Harville
7,910,175 B2 3/2011 Webber
7,911,651 B2 3/2011 Ostromoukhov et al.
7,924,278 B2 4/2011 Loop et al.
7,952,557 B2 5/2011 Amundson et al.
7,952,790 B2 5/2011 Honeyman et al.
7,956,841 B2 6/2011 Albert et al.
7,982,479 B2 7/2011 Wang et al.
7,982,941 B2 7/2011 Lin et al.
7,999,787 B2 8/2011 Amundson et al.
8,040,357 B1 10/2011 Hutchins et al.
8,040,594 B2 10/2011 Paolini, Jr. et al.
8,054,526 B2 11/2011 Bouchard
8,077,141 B2 12/2011 Duthaler et al.
8,085,438 B2 12/2011 Hersch et al.
8,098,418 B2 1/2012 Paolini, Jr. et al.
8,125,501 B2 2/2012 Amundson et al.
8,139,050 B2 3/2012 Jacobson et al.
8,159,636 B2 4/2012 Sun et al.
8,174,490 B2 5/2012 Whitesides et al.
8,213,076 B2 7/2012 Albert et al.
8,243,013 B1 8/2012 Sprague et al.
8,274,472 B1 9/2012 Wang et al.
8,289,250 B2 10/2012 Zehner et al.
8,300,006 B2 10/2012 Zhou et al.
8,305,341 B2 11/2012 Arango et al.
8,314,784 B2 11/2012 Ohkami et al.
8,363,299 B2 1/2013 Paolini, Jr. et al.
8,373,649 B2 2/2013 Low et al.
8,384,658 B2 2/2013 Albert et al.
8,422,116 B2 4/2013 Sprague et al.
8,441,714 B2 5/2013 Paolini, Jr. et al.
8,441,716 B2 5/2013 Paolini, Jr. et al.
8,456,414 B2 6/2013 Lin et al.
8,462,102 B2 6/2013 Wong et al.
8,466,852 B2 6/2013 Drzaic et al.
8,503,063 B2 8/2013 Sprague
8,514,168 B2 8/2013 Chung et al.
8,514,932 B2 8/2013 Stefanowski et al.
8,537,105 B2 9/2013 Chiu et al.
8,558,783 B2 10/2013 Wilcox et al.
8,558,785 B2 10/2013 Zehner et al.
8,558,786 B2 10/2013 Lin
8,558,833 B1 10/2013 Moreton
8,558,855 B2 10/2013 Sprague et al.
8,576,164 B2 11/2013 Sprague et al.
8,576,259 B2 11/2013 Lin et al.
8,576,470 B2 11/2013 Paolini, Jr. et al.
8,576,475 B2 11/2013 Huang et al.
8,576,476 B2 11/2013 Telfer et al.
8,593,396 B2 11/2013 Amundson et al.
8,593,721 B2 11/2013 Albert et al.
8,605,032 B2 12/2013 Liu et al.
8,605,354 B2 12/2013 Zhang et al.
8,619,085 B2 12/2013 Keall et al.
8,630,022 B2 1/2014 Lin et al.
8,643,595 B2 2/2014 Chung et al.
8,649,084 B2 2/2014 Wang et al.
8,665,206 B2 3/2014 Lin et al.
8,665,296 B2 3/2014 Zulch
8,670,174 B2 3/2014 Sprague et al.
8,681,191 B2 3/2014 Yang et al.
8,704,756 B2 4/2014 Lin
8,717,664 B2 5/2014 Wang et al.
8,730,153 B2 5/2014 Sprague et al.
8,786,935 B2 7/2014 Sprague
8,797,634 B2 8/2014 Paolini, Jr. et al.
8,810,525 B2 8/2014 Sprague
8,810,899 B2 8/2014 Sprague et al.
8,830,559 B2 9/2014 Honeyman et al.
8,873,129 B2 10/2014 Paolini, Jr. et al.
8,902,153 B2 12/2014 Bouchard et al.
8,902,491 B2 12/2014 Wang et al.
8,917,439 B2 12/2014 Wang et al.
8,928,562 B2 1/2015 Gates et al.
8,928,641 B2 1/2015 Chiu et al.

(56) References Cited

U.S. PATENT DOCUMENTS 8,941,662 B2 1/2015 Pfeifle
8,964,282 B2 2/2015 Wang et al.
8,976,444 B2 3/2015 Zhang et al.
9,013,394 B2 4/2015 Lin
9,013,783 B2 4/2015 Sprague
9,019,197 B2 4/2015 Lin
9,019,198 B2 4/2015 Lin et al.
9,019,318 B2 4/2015 Sprague et al.
9,082,352 B2 7/2015 Cheng et al.
9,116,412 B2 8/2015 Lin
9,137,504 B2 9/2015 Gelb et al.
9,146,439 B2 9/2015 Zhang
9,164,207 B2 10/2015 Honeyman et al.
9,170,467 B2 10/2015 Whitesides et al.
9,170,468 B2 10/2015 Lin et al.
9,171,508 B2 10/2015 Sprague et al.
9,182,646 B2 11/2015 Paolini, Jr. et al.
9,195,111 B2 11/2015 Anseth et al.
9,199,441 B2 12/2015 Danner
9,218,773 B2 12/2015 Sun et al.
9,224,338 B2 12/2015 Chan et al.
9,224,342 B2 12/2015 Sprague et al.
9,224,344 B2 12/2015 Chung et al.
9,230,492 B2 1/2016 Harrington et al.
9,251,736 B2 2/2016 Lin et al.
9,262,973 B2 2/2016 Wu et al.
9,268,191 B2 2/2016 Paolini, Jr. et al.
9,269,311 B2 2/2016 Amundson
9,285,649 B2 3/2016 Du et al.
9,293,511 B2 3/2016 Jacobson et al.
9,299,294 B2 3/2016 Lin et al.
9,311,890 B2 4/2016 Morovic et al.
9,341,916 B2 5/2016 Telfer et al.
9,360,733 B2 6/2016 Wang et al.
9,361,836 B1 6/2016 Telfer et al.
9,383,623 B2 7/2016 Lin et al.
9,412,197 B2 8/2016 Goel et al.
9,423,666 B2 8/2016 Wang et al.
9,459,510 B2 10/2016 Lin
9,495,918 B2 11/2016 Harrington et al.
9,501,860 B2 11/2016 Barringer et al.
9,513,527 B2 12/2016 Chan et al.
9,530,241 B2 12/2016 Engh-Halstvedt et al.
9,541,814 B2 1/2017 Lin et al.
9,564,088 B2 2/2017 Wilcox et al.
9,612,502 B2 4/2017 Danner et al.
9,620,048 B2 4/2017 Sim et al.
9,620,067 B2 4/2017 Harrington et al.
9,671,668 B2 6/2017 Chan et al.
9,672,766 B2 6/2017 Sjodin
9,691,333 B2 6/2017 Cheng et al.
9,697,778 B2 7/2017 Telfer et al.
9,721,495 B2 8/2017 Harrington et al.
9,740,076 B2 8/2017 Paolini et al.
9,759,980 B2 9/2017 Du et al.
9,792,861 B2 10/2017 Chang et al.
9,792,862 B2 10/2017 Hung et al.
9,812,073 B2 11/2017 Lin et al.
9,966,018 B2 5/2018 Gates et al.
10,162,242 B2 12/2018 Wang et al.
10,209,556 B2 2/2019 Rosenfeld et al.
10,229,641 B2 3/2019 Yang et al.
10,319,313 B2 6/2019 Harris et al.
2003/0021437 A1 1/2003 Hersch et al.
2003/0102858 A1 6/2003 Jacobson et al.
2004/0246562 A1 12/2004 Chung et al.
2005/0093768 A1* 5/2005 Devos ..... G06F 3/1446 345/1.3
2005/0253777 A1 11/2005 Zehner et al.
2007/0091418 A1 4/2007 Danner et al.
2007/0103427 A1 5/2007 Zhou et al.
2007/0176912 A1 8/2007 Beames et al.
2008/0024429 A1 1/2008 Zehner
2008/0024482 A1 1/2008 Gates et al.
2008/0043318 A1 2/2008 Whitesides et al.
2008/0048970 A1 2/2008 Drzaic et al.
2008/0136774 A1 6/2008 Harris et al.
2008/0303780 A1 12/2008 Sprague et al.
2009/0174651 A1 7/2009 Jacobson et al.
2009/0195758 A1 8/2009 Sobel et al.
2009/0225398 A1 9/2009 Duthaler et al.
2009/0322721 A1 12/2009 Zehner et al.
2010/0156780 A1 6/2010 Jacobson et al.
2010/0194733 A1 8/2010 Lin et al.
2010/0194789 A1 8/2010 Lin et al.
2010/0220121 A1 9/2010 Zehner et al.
2010/0265561 A1 10/2010 Gates et al.
2011/0043543 A1 2/2011 Chen et al.
2011/0063314 A1 3/2011 Chiu et al.
2011/0175875 A1 7/2011 Lin et al.
2011/0193840 A1 8/2011 Amundson et al.
2011/0193841 A1 8/2011 Amundson et al.
2011/0199671 A1 8/2011 Amundson et al.
2011/0221740 A1 9/2011 Yang et al.
2012/0001957 A1 1/2012 Liu et al.
2012/0098740 A1 4/2012 Chiu et al.
2012/0326957 A1 12/2012 Drzaic et al.
2013/0063333 A1 3/2013 Arango et al.
2013/0194250 A1 8/2013 Amundson et al.
2013/0242378 A1 9/2013 Paolini, Jr. et al.
2013/0249782 A1 9/2013 Wu et al.
2013/0278995 A1 10/2013 Drzaic et al.
2014/0009817 A1 1/2014 Wilcox et al.
2014/0055840 A1 2/2014 Zang et al.
2014/0078576 A1 3/2014 Sprague
2014/0204012 A1 7/2014 Wu et al.
2014/0240210 A1 8/2014 Wu et al.
2014/0253425 A1 9/2014 Zalesky et al.
2014/0293398 A1 10/2014 Wang et al.
2014/0362213 A1 12/2014 Tseng
2015/0055034 A1* 2/2015 Pipitone ..... G02F 1/13338 349/12
2015/0097877 A1 4/2015 Lin et al.
2015/0118390 A1 4/2015 Rosenfeld et al.
2015/0262255 A1 9/2015 Khajehnouri et al.
2015/0262551 A1 9/2015 Zehner et al.
2015/0268531 A1 9/2015 Wang et al.
2015/0301246 A1 10/2015 Zang et al.
2016/0026062 A1 1/2016 Zhang
2016/0048054 A1 2/2016 Danner
2016/0091770 A1 3/2016 Bouchard et al.
2016/0140910 A1 5/2016 Amundson
2016/0148426 A1 5/2016 Son et al.
2016/0276737 A1* 9/2016 Nakamura ..... H01Q 1/50
2016/0323556 A1 11/2016 Luginbuhl et al.
2018/0276790 A1 9/2018 Mantor et al.

OTHER PUBLICATIONS

Ostromoukhov, Victor et al., "Multi-Color and Artistic Dithering", Proceedings of the 26th Annual Conference on Computer Graphics and Interactive Techniques, ACM Press / Addison-Wesley Publishing Co. (1999).

Kolpatzik, Bernd W. et al., "Optimized Universal Color Palette Design for Error Diffusion", Journal of Electronic Imaging, vol. 4, No. 2, pp. 131-142 (Apr. 1995).

Federal Institute of Industrial Property; PCT/US2017/032148; International Search Report and Written Opinion; Russian Federation; dated Sep. 14, 2017.

European Patent Office, EP Appl. No. 17803278.5, European Search Report, dated May 3, 2019.

* cited by examiner

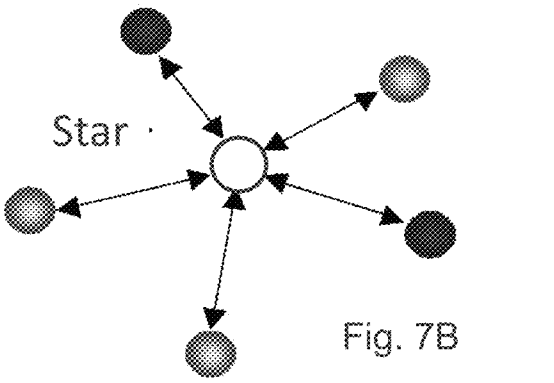
Fig. 7B
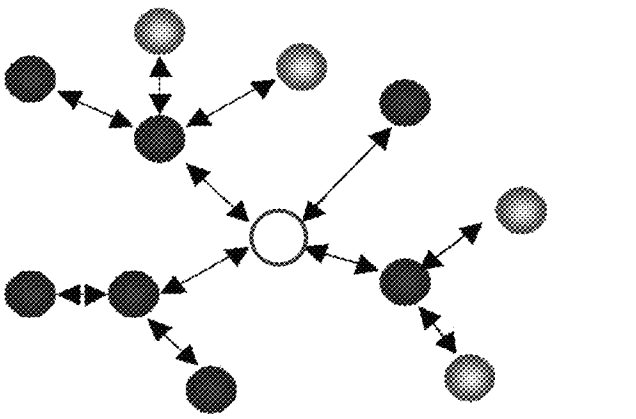
Cluster Tree Fig. 7C
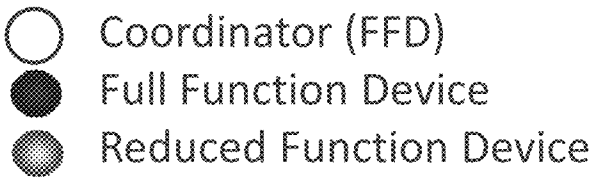
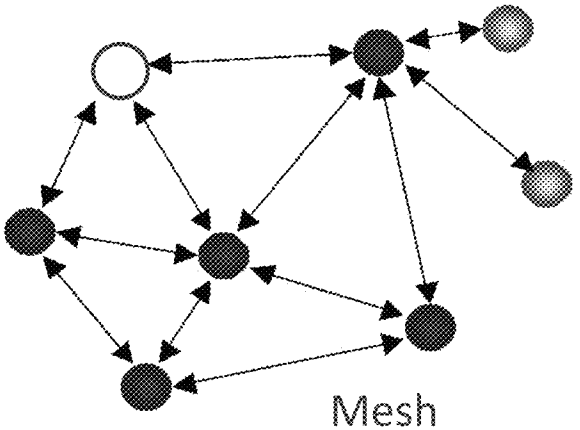
Mesh Fig. 7D

DISPLAYS INTENDED FOR USE IN ARCHITECTURAL APPLICATIONS

REFERENCE TO RELATED APPLICATIONS

This application is a continuation-in-part of pending U.S. patent application Ser. No. 15/241,114, filed Aug. 19, 2016, which claims the benefit of provisional Application Ser. No. 62/207,066, filed Aug. 19, 2015.

This application is also related to copending application Ser. No. 14/934,662, filed Nov. 6, 2015; and to copending application Ser. No. 15/165,795, filed May 26, 2016.

The entire contents of these patents and copending applications, and of all other U.S. patents and published and copending applications mentioned below, are herein incorporated by reference.

BACKGROUND OF INVENTION

This invention relates to displays intended for use in architectural applications, and to buildings and similar structures incorporating such displays.

The recent development of low power bistable displays which are light in weight has led to consideration of the use of such displays on buildings and similar structures to allow changes in the appearance of the buildings, either for esthetic purposes or to control energy absorption and reflection. However, constructing displays which can cover the whole or a substantial portion of the external surface of a large building is attended with numerous difficulties. If a building is hundreds or thousands of feet in length, making a display on that scale as a single element is nearly impossible, and even making a static display or artwork of that scale is difficult time consuming and expensive. Accordingly, such a large display needs to be divided up into sections and assembled together with coordination among the different sections of the display. In constructing large (billboard sized) LED displays it is known to make smaller display sections which need to be assembled on a large mechanical frame to create the whole billboard sized display with many wires connected to each display section to coordinate the operation of the billboard display sections. This method of creating large displays results in a thick, heavy display, requires numerous long runs of electrical wiring, and consumes a lot of power. For displays covering architectural elements, like buildings, hundreds or thousands of feet in length, many stories tall, requiring low resolution, to show pattern changing content and not alphanumeric information display, it would be advantageous to devise a thinner, lightweight, structure that would not require complex and expensive electrical and signal wiring, and could be integrated with the architecture without heavy and bulky structural members. This invention seeks to provide such a structure.

SUMMARY OF INVENTION

Accordingly, in one aspect this invention provides a display comprising:

a weatherproof housing;

a bistable electro-optic medium enclosed within the weatherproof housing and visible through the housing;

at least one electrode enclosed within the weatherproof housing and arranged to apply an electric field to the bistable electro-optic medium;

a power source enclosed within the weatherproof housing;

data receiving means enclosed within the weatherproof housing and arranged to receive data wirelessly from a source outside the weatherproof housing; and display drive means arranged to receive data from the data receiving means and power from the power source, and to control the potentials of the at least one electrode.

The term "weatherproof" housing is used herein in its conventional meaning of a housing which isolates the components within the housing from the effects of weather outside the housing. The weatherproof housing should at least protect its internal components from the effects of rain and dust incident upon the housing. Depending upon the climate in which the display is to be used, the weatherproof housing may have additional properties; for example in cold climates, it should protect the internal components from the effects of frost, snow or ice present on the exterior of the housing, while in climates susceptible to sandstorms, the weatherproof housing should desirably be resistant to the corrosive effect of windblown sand to avoid the view of the electro-optic medium being obscured by damage to the housing.

The terms "bistable" and "bistability" are used herein in their conventional meaning in the art to refer to displays comprising display elements having first and second display states differing in at least one optical property, and such that after any given element has been driven, by means of an addressing pulse of finite duration, to assume either its first or second display state, after the addressing pulse has terminated, that state will persist for at least several times, for example at least four times, the minimum duration of the addressing pulse required to change the state of the display element. It is shown in U.S. Pat. No. 7,170,670 that some particle-based electrophoretic displays capable of gray scale are stable not only in their extreme black and white states but also in their intermediate gray states, and the same is true of some other types of electro-optic displays. This type of display is properly called "multi-stable" rather than bistable, although for convenience the term "bistable" may be used herein to cover both bistable and multi-stable displays.

An external surface of the weatherproof housing may be equipped with an adhesive layer capable of attaching the display to a surface of a building. The power source, which may be a photovoltaic cell or a broadcast power receiver, may optionally include a power storage unit, such as a rechargeable battery or a supercapacitor, to allow the display to continue to function during periods of darkness or other times when the power source is not generating sufficient power for the requirements of the display.

In another aspect this invention provides a building equipped with a display system, the display system comprising:

a plurality of displays each disposed on a surface of the building and each comprising a bistable electro-optic medium; at least one electrode arranged to apply an electric field to the bistable electro-optic medium; a power source; data receiving means arranged to receive data wirelessly; and display drive means arranged to receive data from the data receiving means and power from the power source, and to control the potentials of the at least one electrode; and control means arranged to receive data defining an image to be rendered on the building, to determine the state of each of the plurality of displays necessary to render said image, and to transmit to each of the plurality of displays data required for that display to adopt the state necessary to render the image.

BRIEF DESCRIPTION OF DRAWINGS

FIGS. 7B-7D are schematic illustrations of three network arrangements which may be used to pass data to individual displays in display systems of the present invention.

DETAILED DESCRIPTION

Figure 1:
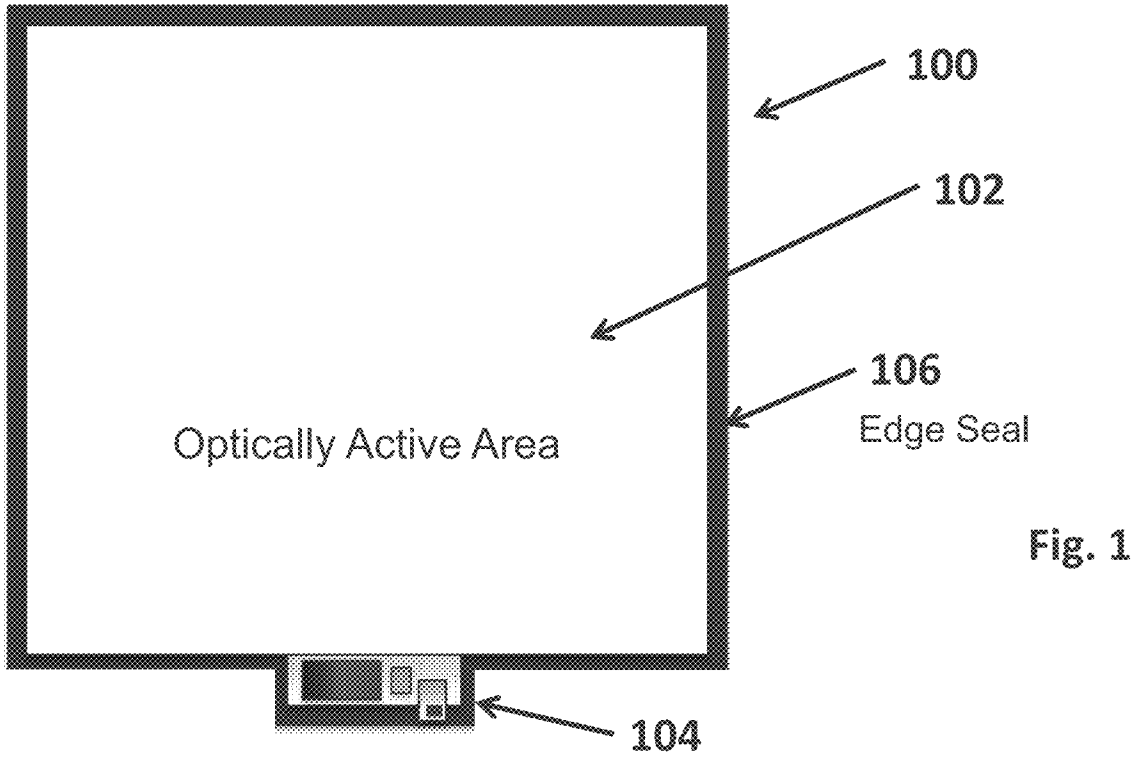
FIG. 1 of the accompanying drawings is a front elevation of a first display of the present invention.

As indicated above, the present invention provides a display which can be attached to an exterior surface of a building to allow changing the appearance of the building. (A display system of the present invention may additionally include displays on the interior surfaces of the building; for example, when used in a parking garage, a display system could include displays on the interior surfaces of the garage to provide variable traffic signs.)

The displays and systems of the present invention are primarily, although not exclusively intended for use with electrophoretic media. Electrophoretic media provide some unique and beneficial features that allow construction of very large displays that address many of the aforementioned issues and enable an architecture well suited for architectural displays of extremely large sizes. The bistability of electrophoretic media allows for low power operation and eliminates the need for wired connection to electrical outlets. Additionally, the bistability allows one or more displays to maintain a display state without the need for additional power input, which can be beneficial for static displays, such as text announcements. The bistability and resultant image persistence of the display can make the power consumption of the display so low that the display can be powered by renewable power harvesting, such as solar cells, or radio frequency (RF) harvesting, depending on the update rate of the display medium and the area ratio of the solar cell or RF collection antenna to the optically active portion of the display.

However, the solar cell is likely to be an optically inactive area of the display and should be as small as possible given the update rate that is desired. For updates limited to one image update every 10 seconds or less, the solar cell can be 5% or less of the electrophoretic medium area or approximately a 20:1 ratio of optically active medium to solar panel.

Another advantage of electrophoretic displays is that they can constructed on thin and flexible substrates. The ability to construct displays on thin plastic substrates means that the media can also be made very thin and lightweight in comparison to light emitting diode (LED) or liquid crystal (LCD); the electrophoretic media can even be made flexible and conformal. Since the medium can be made thin and lightweight, it can be applied directly to a building façade with a simple construction adhesive and does not need heavy mechanical structures or frames to build the individual display into a larger display system. If the control signals for the display system are passed to the individual displays (hereinafter referred to as "tiles") using wireless communication, for example wi-fi, each tile can function in a completely autonomous manner without any need for wires or other connection to other tiles. In some instances, where long periods of inactivity are made possible by the bistability of the display medium, it is also useful for the wireless communication to broadcast the state of the display when it the system receives a request to update the state of an individual display. Depending on the construction materials to which the tiles are adhered, the selection of the transmitter for the wireless connection may critical. For example, if the building material is concrete with metal reinforcing rods ("re-bar"), a special hemispherical antenna (as illustrated in FIG. 7) may be necessary for the wireless communication to function correctly despite the tiles' proximity to a large amount of re-bar. Use of the wireless communication allows for a fully sealed weatherization envelope with no penetrations at all. This is very important to minimize the penetration of water into either the display medium or the control electronics.

Figure 8:
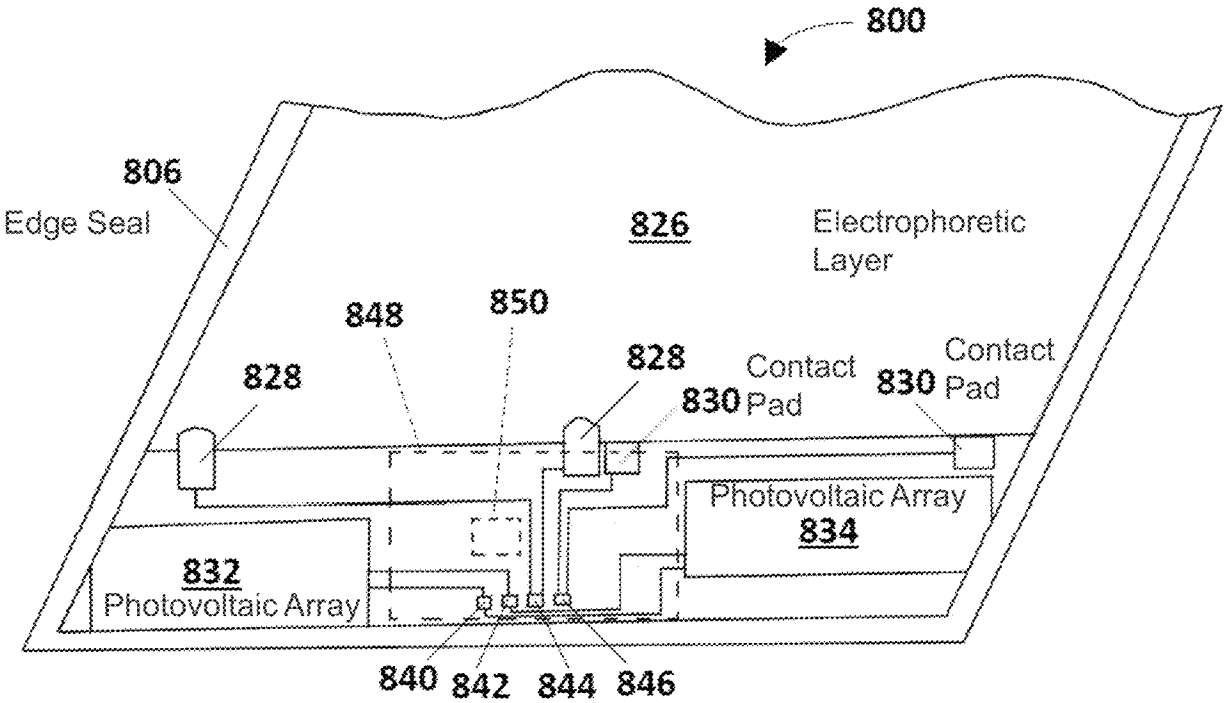
FIG. 8 is a front view of part of a display of the present invention which uses a two-part weatherproof envelope.

It is highly desirable that the weatherproof housing conform closely to the components therein, such that no air gap of more than about 5 mm, a desirably no air gap of more than about 1 mm, exist between the weatherproof housing and its contents. Sections of weatherproof housing which do not closely conform to their contents tend to be more susceptible to mechanical damage. However, providing a closely conformal housing tends to be complicated by the fact that the printed circuit board typically used as a base for the display drive means and the power storage unit (if present) is normally substantially thicker that the remaining components of the display. It has been advantageous, at least in some cases, to form the weatherproof housing in two section, a main (relatively thin) section which houses the display and the power source, and a thicker section, typically in the form of a printed circuit board, housing at least the display drive means. In one form of such a housing, as illustrated in FIG. 8, a limited number of exposed contacts are provided on the first section, and the second section provides conductors which make electrical contact with the exposed contacts. The second section of the weatherproof housing covers the exposed contacts and may have the form of "potting" (in the sense of covering with a polymeric material which is then cured to cover a hard covering) the printed circuit board. An antenna or similar data receiving device may protrude from the potting material to enhance reception of data by the tile.

The tiles of the present invention can have many different sizes and shapes for the optically active area (i.e., the portion of the display in which the electro-optic medium is visible), and two examples will now be described with reference to FIGS. 1 to 5. FIG. 1 is a front elevation of a first tile (generally designated 100) with a square optically active area 102 and a small, optically inactive electronics area 104 arranged along the lower edge (as illustrated) of the optically active area 102. An edge seal area 106 surrounds both the optically active area 102 and the electronics area 104; as described in more detail below, in the edge seal area 106, the front and rear protective stacks are sealed to one another, thus forming a weatherproof enclosure completely surrounding the other components of the tile.

Figure 2:
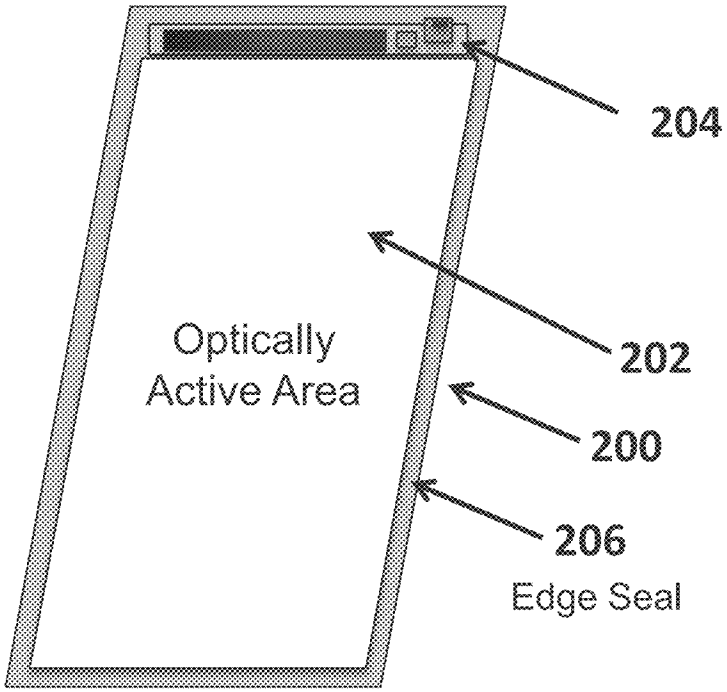
FIG. 2 is a front elevation, similar to that of FIG. 1, of a second display of the present invention.

The second tile 200 shown in FIG. 2 is generally similar to that shown in FIG. 1 except that its optically active area 202 has the form of a parallelogram rather than a square and its electronics area 204 is larger and provided at the upper edge (as illustrated) of the optically active area 202. Again, an edge seal area 206 surrounds both the optically active area 202 and the electronics area 204 to form a weatherproof enclosure completely surrounding the other components of the tile.

Figure 3:
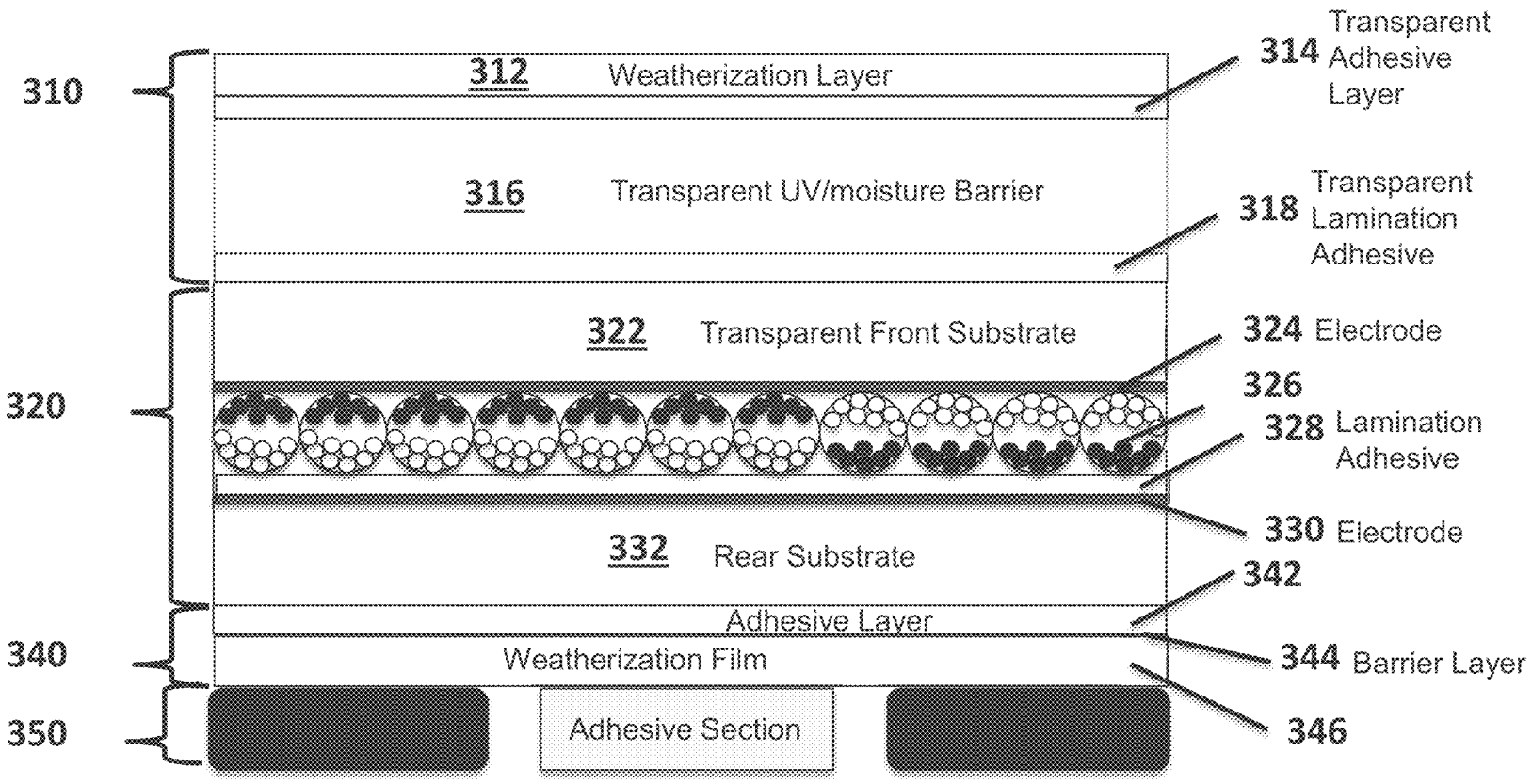
FIG. 3 is a schematic cross-section through a portion of the display shown in FIG. 2.

The overall structure of the tiles 100 and 200 is most easily appreciated from FIG. 3, which shows a schematic cross-section through a central portion of the optically active area 202 of tile 200; tile 100 comprises the same series of layers. As shown in FIG. 3, each tile comprises three main series of layers ("stacks"), namely:

1.) A viewing side or front protective stack (generally designated 310) comprising
   a. a transparent viewing side weatherization layer 312 to protect the internal components of the tile from rain or submersion in water
   b. a transparent adhesive layer 314 for lamination of the weatherization layer 312 to a UV and moisture barrier layer;
   c. a transparent viewing side ultraviolet (UV) and moisture vapor barrier layer 316; and
   d. a transparent adhesive 318 for lamination of the barrier layer 316 to the electrophoretic medium stack described below;
2.) An electrophoretic medium stack (generally designated 320) comprising
   a. a transparent front substrate 322;
   b. a transparent front electrode 324;
   c. a layer of solid electro-optic material 326, illustrated as an encapsulated electrophoretic medium;
   d. a layer of lamination adhesive 328;
   e. a backplane or rear electrode 330, which may or may not be transparent depending upon the intended use of the tile; and
   f. a rear transparent substrate 332;
3.) A backplane side or rear protective stack (generally designated 340) comprising
   a. an adhesive layer 342 for attaching the rear protective stack 340 to the electrophoretic medium stack 320;
   b. a moisture vapor barrier layer 344; and
   c. a weatherization film 346 to protect the tile from rain or submersion in water.

The tile further comprises an adhesive section 350, used to attach the tile to a building façade or other structural feature; this adhesive section 350 will be described in more detail below with reference to FIG. 6.

In a preferred embodiment of the tile of the present invention, the details of the various layers shown in FIG. 3 are as follows. The front protective stack 310 larger in size than the electrophoretic medium stack 320 to allow the formation of a pinched edge seal in combination with the rear protective stack in order to provide the edge seal area 206 (FIG. 2). In the tile 200 shown in FIGS. 2 and 3, the front protective stack 310 extends 1 cm beyond the peripheries of both the electrophoretic medium stack 320 and the electronics area 204, and the same is true in FIG. 1. In an alternative embodiment the weatherization layer 312 and its associated adhesive layer 314 extend beyond the edges of the barrier layer 316, which itself extends beyond the edges of the electrophoretic medium stack 320, thus permitting the formation of a first pinched edge seal between the front and rear weatherization films 312 and 346, and a second pinched seal between the front and rear barrier films 316 and 344.

In this preferred embodiment, the front weatherization layer 312 is a 50μ film of poly(ethylene tetrafluoroethylene) (ETFE) with one surface of the film (that facing the adhesive layer 314) provided with an adhesion promotion treatment. Such ETFE are available commercially, for example from St. Gobain. The adhesive layer 314 is a pressure sensitive adhesive (PSA) from example 8171 OCA from 3M Corporation. This material is of high transparency and can be laminated at room temperature. Alternatively, a hot melt adhesive, for example Bemis EVA, can be used; hot melt adhesives tend to be slightly lower cost than PSA's but require higher temperatures for lamination.

Figure 4:
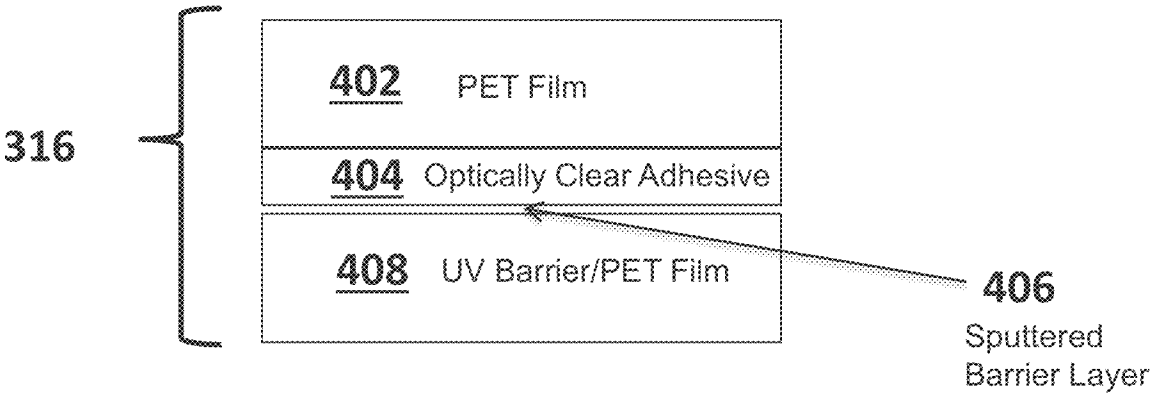
FIG. 4 is an enlarged cross-section through the front protective sheet shown in FIG. 3.

The front barrier layer 316 is itself a multi-layer stack, of which a schematic cross-section in FIG. 4. As shown in that Figure, the barrier layer 316 comprises, in order from the adhesive layer 314, a front UV barrier poly(ethylene terephthalate) (PET) film 402, a layer of optically clear adhesive 404, a sputtered barrier layer 406, typically indium tin oxide (ITO), and a rear UV barrier PET film 408. Alternatively various multi-layer proprietary materials may be used, for example Konica Minolta KMBD07-07, or 3M Ultrabarrier. Another alternative is a single layer of fluorinated ethylene propylene (FEP). The adhesive layer 318 may use any of materials already described for use in adhesive layer 314.

The front substrate 322 and front electrode 324 are both formed from a 5 mil (127 μm) ITO-coated PET film; other thickness of PET and possibly other polymers can be used. The ITO layer typically has a conductivity of about 5000 Ohm/square, but lower and higher conductivities can be used. Too low a conductivity tends to lead to problems with continuity and reliability of conductivity, while too high a conductivity (i.e., too thick an ITO layer) results in excessive light loss in the ITO layer. Other clear conductors, such as PEDOT, CNT, graphene, and nanowires, could be substituted for the ITO front electrode. The electrophoretic layer 326 may be any of the electrophoretic media described in the E Ink patents and applications mentioned below. The layer of lamination adhesive 328 is a custom polyurethane latex adhesive doped with an imidazolium hexafluorophosphate dopant to control electrical properties, essentially as described in U.S. Pat. No. 8,446,664. The rear electrode 330 and rear substrate 332 can be formed from the same PET/ITO film as the front substrate 322 and front electrode 324; alternatively, the rear electrode 330 could be a printed carbon conductor if a single pixel covering the entire display area is required, or another low cost transparent or non-transparent conductor.

The adhesive layer 342 may use any of materials already described for use in the adhesive layers 314 and 318. The adhesive layer 314 need not be transparent if the electro-optic layer 326 is of a reflective type, since the adhesive layer 342 is behind the optically active layer, as viewed from the viewing surface (the surface of the front weatherization layer 312) of the tile. In actual practice, the functions of the barrier layer 344 and weatherization layer 346 shown in FIG. 3 can both be handled by a single commercial film, in the form of a 50 μm metallized PET barrier material, for example that made by Nitto Denko. This film is opaque but this is acceptable provided the electro-optic layer 326 is reflective and the layer 344 and 346 lie behind the electro-optic layer. Alternatively, many commercial fluoropolymer films can be used.

Figure 5:
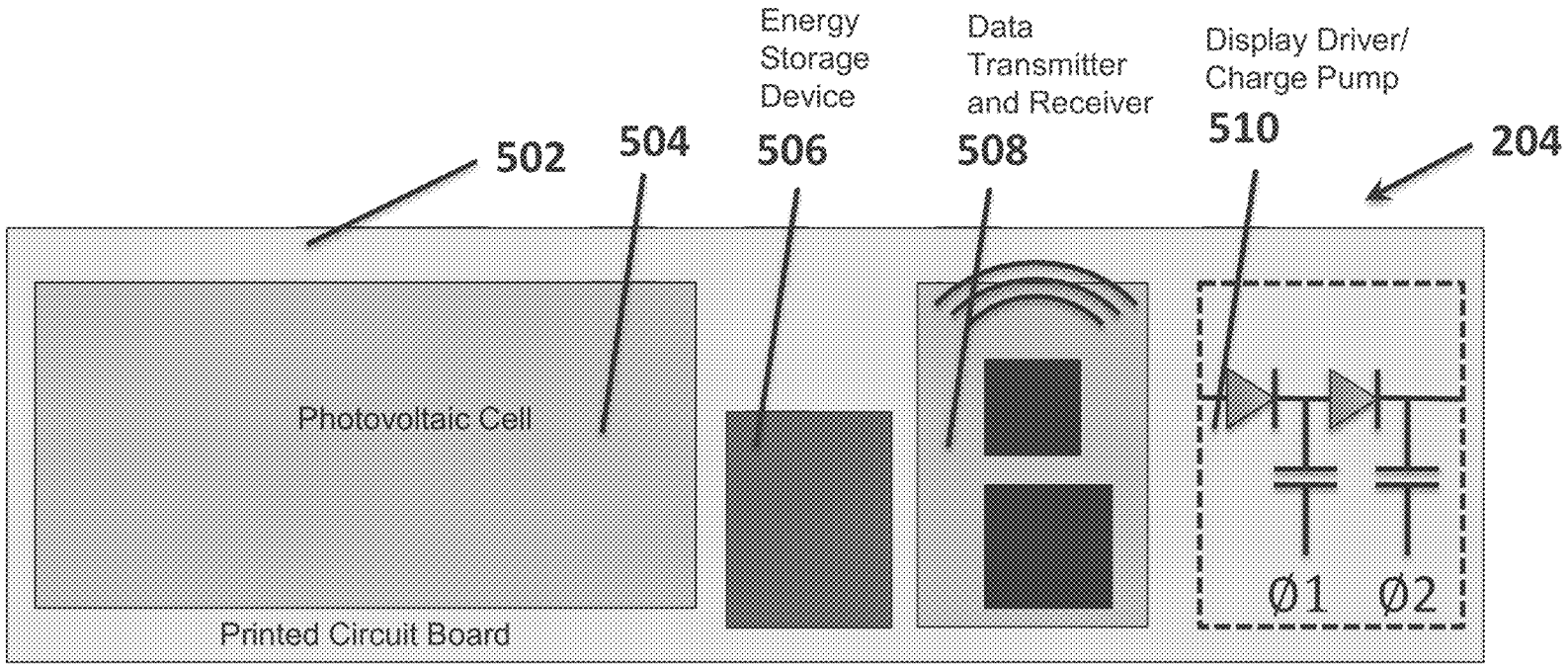
FIG. 5 is an enlarged front elevation of the electronics portion of the display shown in FIG. 2.

FIG. 5 is an enlarged front elevation of the electronics area 204 of the tile 200 shown in FIG. 2. The electronic area 204 is formed on a single printed circuit board (PCB) 502; alternatively, multiple PCBs may be used for spatial or signal quality considerations. All the elements of the electronics are full enclosed by the weatherization layers 312 and 346 (FIG. 3). As shown in FIG. 5, there are mounted on the PCB 502, a solar (photovoltaic) cell 504, an energy storage device 506, a wireless data receiver and transmitter 508 and a display driver/charge pump 510.

The solar cell 504 is preferably a flexible solar cell, such as a Power Film MP3-37 Flexible A-Si cell, which gives high efficiency in the low light conditions. Numerous other sizes and shapes of solar cell can be used depending upon the size and shape of the tile. Choosing a flexible solar cell also allows the tiles to be flexible including the electronics package. There are many commercial solar options to choose from in addition to the flexible ones. Alternatively, other power harvesting options, such as RF harvesting, can be used.

The energy storage device 506 poses difficult design considerations in view of the need for high energy density, high temperature performance, and (say) 10 year minimum lifetime. Options include primary batteries, rechargeable batteries, and supercapacitors, with supercapacitors generally for a balance of properties. The supercapacitor is the lowest energy of the options for power harvesting but a 2-5 farad supercapacitor coupled with a solar cell will typically provide enough power to meet the power demands of a tile overnight. The supercapacitor option has the best high temperature performance and is capable of the most charge and discharge cycles of all of the options. A combination of a supercapacitor and a solar cell provides potentially indefinite working lifetime. If a combination of solar cell and supercapacitor is unable to provide sufficient power for operation in a particular location, a rechargeable battery may be substituted. Rechargeable batteries with high energy densities, such as lithium ion batteries, can be dangerous at high temperature. Primary cell batteries can power the tiles but inevitably limit the working lifetime of a tile.

The data transmitter and receiver 508 must be of low power to operate within the power budget available from the solar cell 502. Many commercial transceivers can be used, for example a 2.4 GHz System-On-Chip transceiver by Dust Networks from Linear Technology. The LTC5800 family of transceivers was used because of the low transmit/receive power, and its ability to implement a mesh network topology. Other technology choices exist for low power mesh transceivers, such as the Bluetooth Low energy chipset from Nordic Semiconductor; the nRF51822. In some instances, the data transmitter and receiver 508 will have a deep sleep option whereby the data transmitter and receiver 508 can be inactive for long periods of time and only activate upon receiving a wake-up signal from the controller (discussed below).

The display driver/charge pump 510 may be, for example, an Ultrachip UC8111, 96 segment driver with integrated charge pump. This chip can generate ±15V and 0V. There are many alternative driver chips commercially available and known to be capable of driving electrophoretic and similar media. Another alternative is a 10 stage discrete charge pump but this option tends to expensive.

Figure 6:
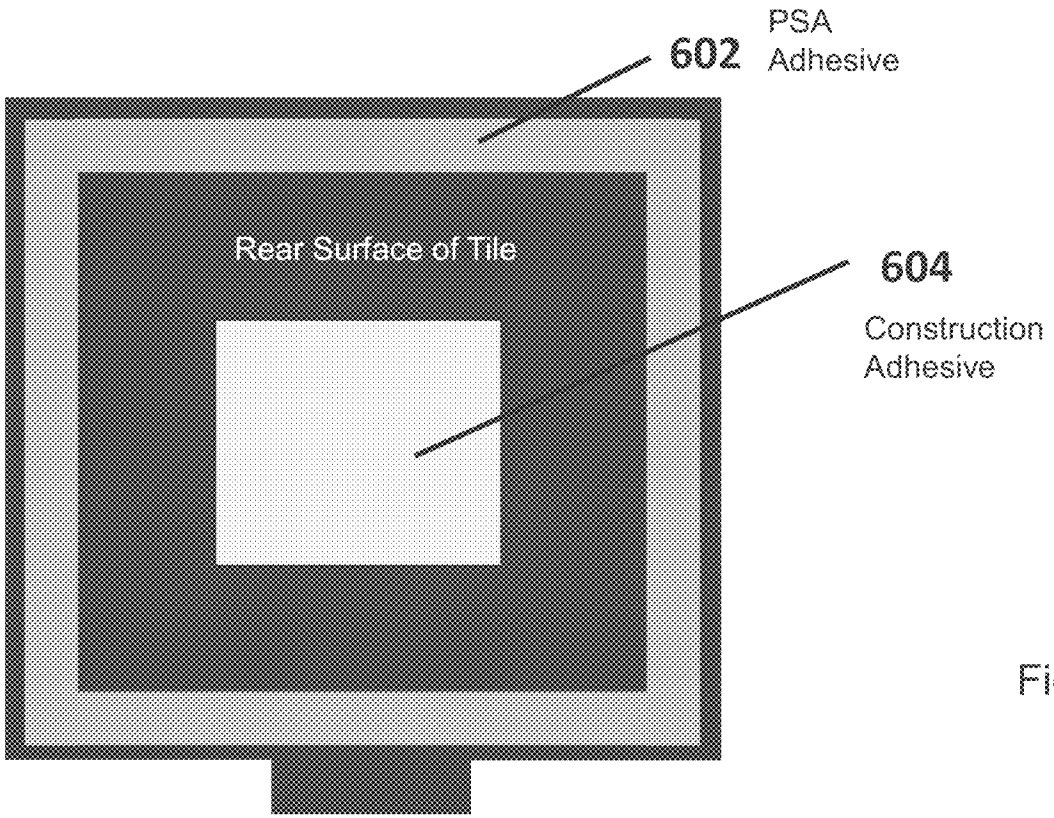
FIG. 6 is a schematic rear elevation of the display shown in FIG. 1 illustrating the adhesive pad used to attach the display to a building.

FIG. 6 is a rear elevation of a tile similar to the tile 100 shown in FIG. 1 and illustrates an adhesive section similar to the adhesive section 350 shown in FIG. 3. As shown in FIG. 6, two separate adhesive areas are present on rear surface of the tile. A 2 inch (51 mm) border 602 extending around the periphery of the tile is formed from a PSA construction adhesive called BITE Mastosplice which is a butyl rubber product tape product. This tape is used to create a perimeter of adhesive around the rear surface of the tile and adheres instantly and well to concrete and other building materials at room temperature with minimal pressure. A central area 604 of adhesive is formed from Sikaflex 11FC which is a dispensed liquid construction adhesive that cures to very high adhesion strength but is not instantly self-supporting and takes 30 to 60 minutes to cure enough to be sure to be self-supporting. This combination of adhesives is since the PSA adhesive at 602 sticks instantly and may be strong enough on its own to support the weight of the tile but the adhesive at 604 when cured is much stronger and results in a stronger attachment of the tile. However, in some cases, the adhesion of liquid construction adhesive may be so strong that if removal of the tile is attempted after the construction adhesive has cured, serious damage to the surface to which the tile is attached may result. Hence, at least in some cases, it may be desirable to omit the liquid adhesive and provide additional areas of adhesive tape to attach the tile to a building or other structure.

Depending on the construction materials that the tiles are adhered to, the selection of the transmitter for the wireless antenna also becomes critical. For example, if the building material is concrete with re-bar then a special hemispherical antenna may be necessary to function properly with all of the re-bar in close proximity. Suitable antennae are available commercially, for example the Taoglas Model SWLP-12 antenna, manufactured by Taoplas of Enniscorthy, County Wexford, Ireland; a specification for this antenna can be found at https://taoglas.com/images/product_images/original_images/-SWLP.2450.12.4.B.02%20SMD%202.4%20GHz%20Patch%20Antenna%20140110.pdf. Such antennae typically use a metallic backplane to cause radiation to be emitted in a substantially hemispherical pattern, thus avoiding excessive absorption of the signal by metal present within the building structure.

Figure 7A:
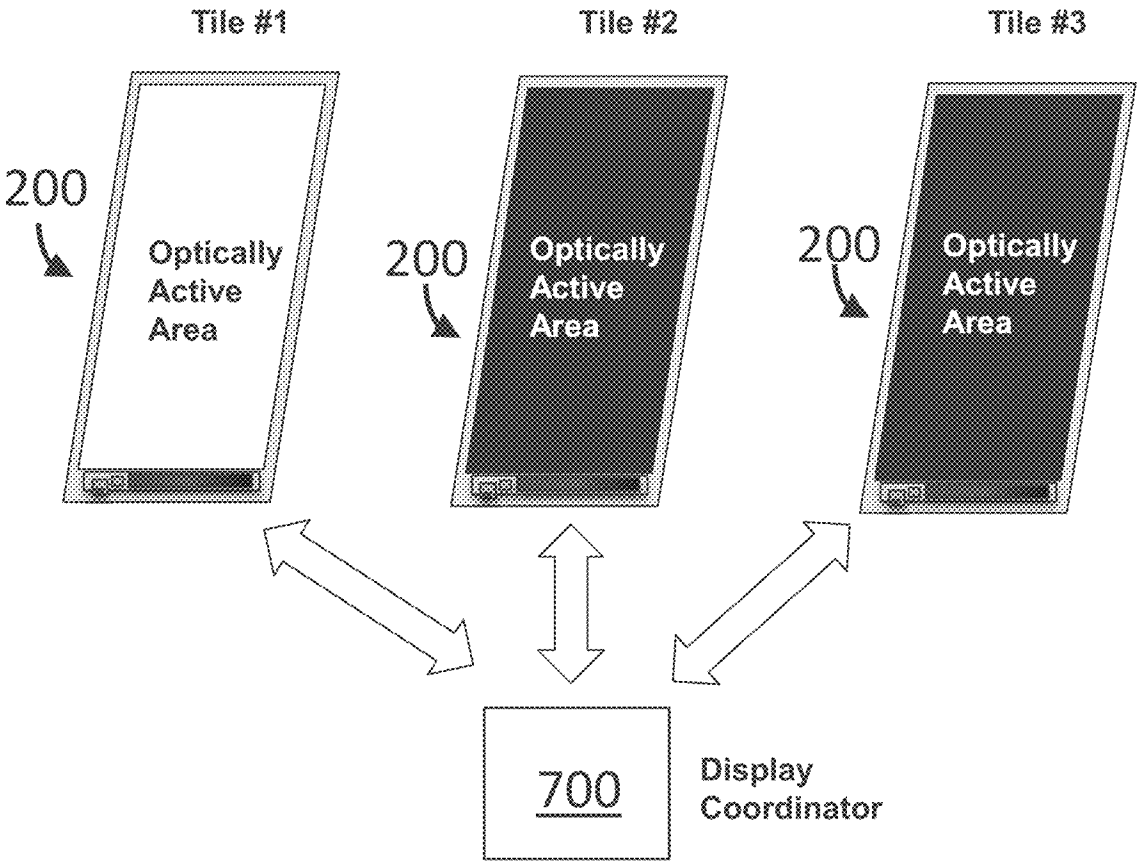
FIG. 7A illustrates wireless communication of display states between a plurality of display and a coordinator.

Display systems of the present invention will typically use one central unit or coordinator 700 arranged to receive data defining an image to be rendered on the building; such as shown in FIG. 7A. A dynamic image may simply consist of storing a plurality of images to be displayed and the times at which the images are to be displayed in the memory of the coordinator 700. The coordinator 700 determines the state of each of the plurality of displays 200 necessary to render the image to be displayed, and transmits to each of the tiles data required for that display to adopt the state necessary to render the image. In some instances, for example after one or more displays 200 has remained static for some time, it is useful for the display 200 to broadcast its current display state wirelessly with the data transmitter and receiver 508 (not shown in FIG. 7A). Typically, the necessary data transfer will be effected in a manner which will be familiar to anyone familiar with networking or internet technology: the coordinator 700 transmits a series of packages of information with each package containing an address portion identifying the tile for which it is intended, and a data portion specifying the image to be displayed on that tile. In some embodiments, each tile 200 "listens" to all packages put only acts in response to packages bearing its own address. (In the case of the cluster tree and mesh topologies described below, in which some tiles communicate with the coordinator only via other "switching" tiles, each switching tile must of course receive not only its own data but also those of all the tiles which receive their data through it.) The address portion of each package may be a serial number or similar unique identifier of a particular tile; this allows for relative easy replacement of a damaged, destroyed or malfunctioning tile, since it only necessary to advise the coordinator of the serial numbers etc. of the replaced and the new tile. In advanced embodiments, the controller 700 will receive display information wirelessly from the display tiles 200, and use the updated display state information to create the desired image by requiring the minimum number of new updates, thereby conserving energy for the system.

As illustrated in FIGS. 7B-7D, there can be different styles of network topologies, such as star, mesh and cluster tree. Mesh network topology is generally preferred due to the high reliability offered. Each transmitter can have multiple paths to connect to its receiver. The aforementioned LTC5800 family is both capable of low power consumption and mesh network topology due to timing synchronization. This allows each transmitter to send data at a prescribed time slot, and run in a low power or sleep mode the rest of the time. The timing accuracy is also relevant for synchronized event management. Specifically an update event can be pre-scheduled with multiple transceivers in order to have an aggregate update occur, even if there is low frequency bandwidth available. Typically Bluetooth Low energy is operated in a Star-network topology, but if running networking firmware from "Wirepas" the Bluetooth low energy chipset can run in a mesh topology with synchronized sleep for low power consumption. Also, there is also an "internet of things" (IoT) open source application called "ConTiki" which can be run on a number of hardware platforms, including the CC2530 chip set from Texas Instruments. This networking suite allows multiple styles of timing synchronization, allowing low power mesh networking through coordinated sleep times.

FIG. 8 is a front view of part of a display (generally designated 800) of the present invention which uses a two-part weatherproof envelope; the portion of the display shown in FIG. 8 corresponds to the topmost portion of FIG. 2 but is inverted relative to FIG. 2. The main portion of the display 800 has a structure similar to that shown in FIG. 3, and comprises an electrophoretic layer 826 provided with upper and lower electrodes (not shown). Two upper contact pads 828 make contact with the upper electrode and two lower contact pads 830 make contact with the lower electrode. Two photovoltaic arrays 832, 834 form the power source of the display. All of the aforementioned components of the display are sealed within a first weatherproof envelope formed by front and rear protective stacks similar to those shown in FIG. 3 and joined to form an edge seal 806. However, the front protective stack is provided with apertures which expose four separate contact pads 840, 842, 844 and 846 near one edge of the display 800. As indicated schematically, the two photovoltaic arrays 832, 834 are connected to contact pads 840 and 842, the two upper contact pads 828 are connected to contact pad 844 and the two lower contact pads 830 are connected to contact pad 846.

A printed circuit board 848 (indicated only schematically in FIG. 8) carries control circuitry and a supercapacitor (neither shown) and overlies the contact pads 840, 842, 844 and 846. Contacts (not shown) on the lower surface of PCB 848 make electrical contact with the contact pads 840, 842, 844 and 846. PCB 848 is potted using a cured resin which extends into contact with the front surface of the front protective stack, thus forming a weatherproof enclosure around PCB 848 and sealing the apertures adjacent contact pads 840, 842, 844 and 846. An antenna 850 (indicated only schematically in FIG. 8) extends through the potting material to allow unhindered reception of data from a control center (not shown).

The displays and display systems of the present invention have been described above largely with reference to electrophoretic electro-optic media. Particle-based electrophoretic display, in which a plurality of charged particles move through a fluid under the influence of an electric field, have been the subject of intense research and development for a number of years. Electrophoretic displays can have attributes of good brightness and contrast, wide viewing angles, state bistability, and low power consumption when compared with liquid crystal displays. Nevertheless, problems with the long-term image quality of these displays have prevented their widespread usage. For example, particles that make up electrophoretic displays tend to settle, resulting in inadequate service-life for these displays.

As noted above, electrophoretic media require the presence of a fluid. In most prior art electrophoretic media, this fluid is a liquid, but electrophoretic media can be produced using gaseous fluids; see, for example, Kitamura, T., et al., "Electrical toner movement for electronic paper-like display", IDW Japan, 2001, Paper HCS1-1, and Yamaguchi, Y., et al., "Toner display using insulative particles charged triboelectrically", IDW Japan, 2001, Paper AMD4-4). See also U.S. Pat. Nos. 7,321,459 and 7,236,291. Such gas-based electrophoretic media appear to be susceptible to the same types of problems due to particle settling as liquid-based electrophoretic media, when the media are used in an orientation which permits such settling, for example in a sign where the medium is disposed in a vertical plane. Indeed, particle settling appears to be a more serious problem in gas-based electrophoretic media than in liquid-based ones, since the lower viscosity of gaseous suspending fluids as compared with liquid ones allows more rapid settling of the electrophoretic particles.

Numerous patents and applications assigned to or in the names of the Massachusetts Institute of Technology (MIT), E Ink Corporation, E Ink California, LLC. and related companies describe various technologies used in encapsulated and microcell electrophoretic and other electro-optic media. Encapsulated electrophoretic media comprise numerous small capsules, each of which itself comprises an internal phase containing electrophoretically-mobile particles in a fluid medium, and a capsule wall surrounding the internal phase. Typically, the capsules are themselves held within a polymeric binder to form a coherent layer positioned between two electrodes. In a microcell electrophoretic display, the charged particles and the fluid are not encapsulated within microcapsules but instead are retained within a plurality of cavities formed within a carrier medium, typically a polymeric film. The technologies described in these patents and applications include:

(a) Electrophoretic particles, fluids and fluid additives; see for example U.S. Pat. Nos. 7,002,728; and 7,679,814;
(b) Capsules, binders and encapsulation processes; see for example U.S. Pat. Nos. 6,922,276; and 7,411,719;
(c) Microcell structures, wall materials, and methods of forming microcells; see for example U.S. Pat. No. 7,072,095; and U.S. Patent Application Publication No. 2014/0065369;
(d) Methods for filling and sealing microcells; see for example U.S. Pat. No. 7,144,942; and U.S. Patent Application Publication No. 2008/0007815;
(e) Films and sub-assemblies containing electro-optic materials; see for example U.S. Pat. Nos. 6,982,178; and 7,839,564;
(f) Backplanes, adhesive layers and other auxiliary layers and methods used in displays; see for example U.S. Pat. Nos. 7,116,318; and 7,535,624;

(g) Color formation and color adjustment; see for example U.S. Pat. Nos. 7,075,502; and 7,839,564;

(h) Methods for driving displays; see for example U.S. Pat. Nos. 7,012,600; and 7,453,445;

(i) Applications of displays; see for example U.S. Pat. Nos. 7,312,784; and 8,009,348; and (j) Non-electrophoretic displays, as described in U.S. Pat. No. 6,241,921; and U.S. Patent Application Publication No. 2015/0277160; and applications of encapsulation and microcell technology other than displays; see for example U.S. Pat. No. 7,615,325; and U.S. Patent Application Publications Nos. 2015/0005720 and 2016/0012710.

Many of the aforementioned patents and applications recognize that the walls surrounding the discrete microcapsules in an encapsulated electrophoretic medium could be replaced by a continuous phase, thus producing a so-called polymer-dispersed electrophoretic display, in which the electrophoretic medium comprises a plurality of discrete droplets of an electrophoretic fluid and a continuous phase of a polymeric material, and that the discrete droplets of electrophoretic fluid within such a polymer-dispersed electrophoretic display may be regarded as capsules or microcapsules even though no discrete capsule membrane is associated with each individual droplet; see for example, the aforementioned U.S. Pat. No. 6,866,760. Accordingly, for purposes of the present application, such polymer-dispersed electrophoretic media are regarded as sub-species of encapsulated electrophoretic media.

Although electrophoretic media are often opaque (since, for example, in many electrophoretic media, the particles substantially block transmission of visible light through the display) and operate in a reflective mode, many electrophoretic displays can be made to operate in a so-called "shutter mode" in which one display state is substantially opaque and one is light-transmissive. See, for example, U.S. Pat. Nos. 5,872,552; 6,130,774; 6,144,361; 6,172,798; 6,271,823; 6,225,971; and 6,184,856. Dielectrophoretic displays, which are similar to electrophoretic displays but rely upon variations in electric field strength, can operate in a similar mode; see U.S. Pat. No. 4,418,346. Other types of electro-optic displays may also be capable of operating in shutter mode. Electro-optic media operating in shutter mode may be useful in multi-layer structures for full color displays; in such structures, at least one layer adjacent the viewing surface of the display operates in shutter mode to expose or conceal a second layer more distant from the viewing surface.

An encapsulated electrophoretic display typically does not suffer from the clustering and settling failure mode of traditional electrophoretic devices and provides further advantages, such as the ability to print or coat the display on a wide variety of flexible and rigid substrates. (Use of the word "printing" is intended to include all forms of printing and coating, including, but without limitation: pre-metered coatings such as patch die coating, slot or extrusion coating, slide or cascade coating, curtain coating; roll coating such as knife over roll coating, forward and reverse roll coating; gravure coating; dip coating; spray coating; meniscus coating; spin coating; brush coating; air knife coating; silk screen printing processes; electrostatic printing processes; thermal printing processes; ink jet printing processes; electrophoretic deposition (See U.S. Pat. No. 7,339,715); and other similar techniques.) Thus, the resulting display can be flexible. Further, because the display medium can be printed (using a variety of methods), the display itself can be made inexpensively.

Other types of electro-optic materials may also be used in the present invention. One type of electro-optic display is a rotating bichromal member type as described, for example, in U.S. Pat. Nos. 5,808,783; 5,777,782; 5,760,761; 6,054,071 6,055,091; 6,097,531; 6,128,124; 6,137,467; and 6,147,791 (although this type of display is often referred to as a "rotating bichromal ball" display, the term "rotating bichromal member" is preferred as more accurate since in some of the patents mentioned above the rotating members are not spherical). Such a display uses a large number of small bodies (typically spherical or cylindrical) which have two or more sections with differing optical characteristics, and an internal dipole. These bodies are suspended within liquid-filled vacuoles within a matrix, the vacuoles being filled with liquid so that the bodies are free to rotate. The appearance of the display is changed by applying an electric field thereto, thus rotating the bodies to various positions and varying which of the sections of the bodies is seen through a viewing surface. This type of electro-optic medium is typically bistable.

Another type of electro-optic display uses an electrochromic medium, for example an electrochromic medium in the form of a nanochromic film comprising an electrode formed at least in part from a semi-conducting metal oxide and a plurality of dye molecules capable of reversible color change attached to the electrode; see, for example O'Regan, B., et al., Nature 1991, 353, 737; and Wood, D., Information Display, 18(3), 24 (March 2002). See also Bach, U., et al., Adv. Mater., 2002,14(11), 845. Nanochromic films of this type are also described, for example, in U.S. Pat. Nos. 6,301,038; 6,870,657; and 6,950,220. This type of medium is also typically bistable.

Another type of electro-optic display is an electro-wetting display developed by Philips and described in Hayes, R. A., et al., "Video-Speed Electronic Paper Based on Electrowetting", Nature, 425, 383-385 (2003). It is shown in U.S. Pat. No. 7,420,549 that such electro-wetting displays can be made bistable.

Some electro-optic materials are solid in the sense that the materials have solid external surfaces, although the materials may, and often do, have internal liquid- or gas-filled spaces. Such displays using solid electro-optic materials may hereinafter for convenience be referred to as "solid electro-optic displays". Thus, the term "solid electro-optic displays" includes rotating bichromal member displays, encapsulated electrophoretic displays, microcell electrophoretic displays and encapsulated liquid crystal displays.

From the foregoing, it will be seen that the present invention can provide a lightweight, flexible, low power alternative to other outdoor display media like LED and LCD signs. The present invention enables dynamic changing of a building façade or other large element with minimal wiring expense and simplified installation.

It will be apparent to those skilled in the art that numerous changes and modifications can be made in the specific embodiments of the invention described above without departing from the scope of the invention. Accordingly, the whole of the foregoing description is to be interpreted in an illustrative and not in a limitative sense.

The invention claimed is:

1. A display system comprising a plurality of bistable displays and a coordinator:

each of the plurality of bistable displays comprising:

a first weatherproof envelope comprising a front protective stack, a rear protective stack, and a peripheral edge seal between the front and rear protective stacks, each of the front and rear protective stacks comprising one or more of a weatherization layer, a UV barrier layer, and a moisture barrier layer, the front protective stack comprising a first plurality of apertures, wherein the first weatherproof envelope additionally contains:

a power source connected to one or more first contact pads, and a layer of a bistable electro-optic medium between a light transmissive electrode layer and a rear electrode layer, the bistable electro-optic medium being visible through the front protective stack, wherein the light transmissive electrode layer and the rear electrode layer are each electrically connected to one or more second contact pads; and a second weatherproof envelope including a second plurality of apertures, arranged to interface with the first plurality of apertures, wherein the second weatherproof envelope contains:

a printed circuit board including control circuitry and comprising a plurality of contacts, the plurality of contacts being electrically connected to the first and second contact pads through the first plurality apertures and the second plurality of apertures, a potting material surrounding the contacts, and an antenna that extends through the potting material, the printed circuit board configured to:

receive data wirelessly from a coordinator located outside the second weatherproof envelope, receive power from the power source disposed in the first weatherproof envelope via an electrical connection to the first contact pads, wirelessly transmit a state of the bistable electro-optic medium to the coordinator, and, set electrical potentials of the light transmissive electrode layer and the rear electrode layer in the first weatherproof envelope via electrical connections to the second contact pads; and the coordinator comprising electrical circuity configured to:

receive data defining an image, wirelessly receive the current state of the bistable electro-optic medium of each bistable display, determine a new state of each of the bistable displays necessary to render said image, and wirelessly transmit to the plurality of bistable displays data required for each bistable display to adopt the new state of the bistable electro-optic medium necessary to render the image.

2. A display system according to claim 1, wherein the printed circuit board within the second weatherproof envelope comprises a power storage unit electrically coupled to the power source, the light transmissive electrode layer, and the rear electrode layer, thereby allowing the printed circuit board to set the electrical potentials of the light transmissive electrode layer and the rear electrode layer when the power source is not generating sufficient power for requirements of the bistable display.

3. A display system according to claim 2, wherein the power storage unit is a supercapacitor.

4. A display system according to claim 1, wherein the bistable electro-optic medium comprises an electrophoretic medium comprising a plurality of charged particles dispersed in a fluid and capable of moving through the fluid when the light transmissive electrode layer and the rear electrode layer apply an electric field to the electrophoretic medium.

5. A display system according to claim 4, wherein the electrophoretic medium is an encapsulated, microcell or polymer-dispersed electrophoretic medium.

* * * * *